US006329958B1

(12) United States Patent
McLean et al.

(10) Patent No.: US 6,329,958 B1
(45) Date of Patent: Dec. 11, 2001

(54) ANTENNA FORMED WITHIN A CONDUCTIVE SURFACE

(75) Inventors: James Stuart McLean; Gentry Elizabeth Crook, both of Austin, TX (US)

(73) Assignee: TDK RF Solutions, Inc., Austin and Cedar Park, TX (US)

( * ) Notice: Subject to any disclaimer, the term of this patent is extended or adjusted under 35 U.S.C. 154(b) by 0 days.

(21) Appl. No.: 09/394,460

(22) Filed: Sep. 11, 1999

Related U.S. Application Data

(60) Provisional application No. 60/099,992, filed on Sep. 11, 1998.

(51) Int. Cl.[7] ..... H01Q 00/00

(52) U.S. Cl. ..... 343/787; 343/700 MS; 343/769

(58) Field of Search ..... 343/705, 713, 343/767, 769, 700 MS, 795; 315/788, 787, 786

(56) References Cited

U.S. PATENT DOCUMENTS

| | | | | |
|---|---|---|---|---|
| 4,839,659 | * | 6/1989 | Stern et al. | 343/787 |
| 5,055,852 | * | 10/1991 | Dusseux et al. | 343/769 |
| 5,327,148 | * | 7/1994 | How et al. | 343/787 |
| 5,539,420 | * | 7/1996 | Dusseux et al. | 343/769 |

* cited by examiner

*Primary Examiner*—Tan Ho
*Assistant Examiner*—Wilson Lee
(74) *Attorney, Agent, or Firm*—Darby & Darby

(57) ABSTRACT

An antenna structure may be formed by arranging a current-restricting structure upon a conductive surface. The current-restricting structure may be formed from a ferrite material, and may be in forms including a belt, tiles, or a patterned deposited layer. The conductive surface may be associated with a vehicle or structure. The current-restricting structure alters the paths taken by current on or beneath the conductive surface when a voltage is applied between portions of the surface.

28 Claims, 7 Drawing Sheets

ANTENNA FORMED WITHIN A CONDUCTIVE SURFACE

RELATED APPLICATIONS

This application claims the benefit of U.S. Provisional Patent Application Ser. No. 60/099,992, filed on Sep. 11, 1998.

BACKGROUND OF THE INVENTION

1. Field of the Invention

The present invention relates generally to the field of antennas, and more specifically to low-profile, conformal, broadband platform-mounted antennas.

2. Description of the Related Art

The descriptions and examples included herein are not admitted to be prior art by virtue of their inclusion in this section.

A wide range of frequencies is currently used in military and commercial communications, from about 3 MHz to about 3 GHz. Although much of commercial cellular telephone communication uses frequencies of about 800 MHz and above, the lower-frequency portion of the above range is very important for applications including military and public safety communications. Commercial pagers also operate at a relatively low frequency of about 150 MHz. Advantages of lower frequencies include improved diffraction around and penetration through obstacles such as walls and foliage, and reduced path loss and attenuation in air, resulting in longer transmission lengths for a given power level. The frequency range from 3 MHz to 30 MHz, designated as the "high-frequency" (HF) communications range, and the 30 MHz to 300 MHz range, called the "very-high-frequency" (VHF) range, are of interest for the lower-frequency applications described above.

Wavelengths in the HF and VHF ranges are on the order of meters to tens of meters. For communications in these ranges, and particularly for mobile communications, it is thus generally necessary to utilize electrically-small antennas, or antennas with geometrical dimensions which are small compared to the wavelengths of the electromagnetic fields they radiate. Unfortunately, electrically-small antennas exhibit large radiation quality factors Q; that is, they store (on time average) much more energy than they radiate. This leads to input impedances which are predominantly reactive and in turn allows the antennas to be impedance-matched only over narrow bandwidths. Furthermore, because of the large radiation quality factors, the presence of even small resistive losses leads to very low radiation efficiencies. In particular, the radiation Q of an electrically-small antenna is roughly proportional to the inverse of its electrical volume, and is essentially inversely proportional to the antenna bandwidth.

It is desirable to communicate over broad frequency ranges, particularly for military communications, in which a wide range of frequency bands is used. Furthermore, military communications may involve bandwidth-intensive techniques such as frequency-hopping to avoid interception and jamming. The above-described constraints on electrical size vs. band-width suggest that physically large antennas and/or multiple antennas are needed to cover a broad frequency range, or large bandwidth, at low frequencies. In practice, large antennas in the form of tall, high-profile whips are frequently used for mobile communications at HF and VHF frequencies. These whip antennas have disadvantages, however. Their high profile makes the antennas observable and relatively fragile. In military applications, high observability is disadvantageous because communications systems are high-priority targets for an enemy. Even in non-combat situations, whip antennas can be damaged during travel in forested terrain, for example. The use of multiple relatively narrowband antennas in order to cover a broad bandwidth is undesirable because it increases system complexity. It would therefore be desirable to develop a low-profile, broadband electrically small antenna.

SUMMARY OF THE INVENTION

The problems outlined above are in large part addressed by a method of employing current-blocking, or "choke", structures to channel current flow on a conducting surface in order to force the current into patterns more conducive to radiation. The choke structure may be in the form of a cord or belt which is arranged upon the surface of a conductor to define one or more lines or shapes. Current in the conductor is prevented from passing over, through, or under the choke structure. Alternatively, the choke structure may be in the form of plates or tiles arranged upon the conductor surface such that areas of the conductor are defined through, over and under which current is prevented from flowing. The current-blocking lines, shapes and/or areas described above may also be formed by broad-area deposition and subsequent patterning of a suitable current-blocking material. The choke structures recited herein, when applied to a conductive structure and combined with a suitable feed arrangement, are expected to result in extremely low-profile broadband electrically-small antennas.

Proper prediction of bandwidth vs. electrical size requires inclusion in the electrical size assessment of any images of the antenna resulting from ground planes or other conducting objects. For example, a large flat conducting ground plane can effectively double the electrical size of the antenna. In this case, the "image" of the antenna is an exact replica of the antenna. It has been shown that finite-sized conducting ground planes or other objects can enhance the operation of an antenna beyond that of an infinite (or electrically-large) ground, especially when the finite ground plane or object is near resonance. Thus it is possible to arrange a situation in which the image of an antenna is actually larger than the antenna itself. Electrical size limitations in the HF and VHF bands make it desirable to somehow utilize a larger-than-life image in order to extract reasonable impedance bandwidth out of a small antenna. This amounts to effectively "using the vehicle as an antenna". In the extreme case, the "antenna" is an electrically-small, near-field probe which would, by itself, radiate very little energy. However, when coupled electrically or magnetically to another larger object, such as a vehicle, this probe excites currents in the other object, causing it to radiate. Both capacitive and inductive probes have been used in previous attempts to exploit vehicles or other objects as radiators: examples of inductive coupling include electrically-small coils or multi-turn loops (MTLs); examples of capacitively-coupled probes include planar inverted-F and inverted-L configurations. Rigorous approaches to utilizing vehicle bodies as radiators have been published which involve deriving the eigenmodes of the vehicle, synthesizing a desired radiation pattern from these modes, and then designing a probe/antenna to excite the modes.

Unfortunately, in all of the above-described previous attempts, only modest improvements in bandwidth have been obtained (over that obtained when the antenna or probe is operated over a ground plane). Attempts to utilize part of a vehicle or other platform as an antenna using an electrically-small probe generally fail because the probe must be large enough to excite currents over a large part of the vehicle. When the probe is nearly the same size as a conventional antenna, little size or observability reduction results. Even if currents could be excited over the entire vehicle, disadvantages are believed to be associated with using an entire vehicle as a radiating element because the vehicle's radiating characteristics could change as the vehicle encountered different grounding situations. For example, a rubber-tired vehicle would be essentially ungrounded when on dry land, while it would be quite well grounded when immersed up to its axles in water or mud. This and other environmental conditions could change both the radiation pattern and input impedance of the antenna, resulting in unpredictable radio system behavior. Furthermore, exciting RF currents over the entire skin of a vehicle could pose a serious radiation hazard to personnel on or near the vehicle.

The method and antenna structure described herein are believed to address these problems by "breaking up" the conductivity of the body of the vehicle in order to (1) force the currents excited by a probe to travel over a large part of the vehicle and (2) confine these currents so that they occupy only the desired area (the top, for example). The structural integrity of the vehicle or other conductor is maintained, however, since portions of the conductor are separated not by, e.g., physically cutting them apart, but rather by restricting current flow between them using the current-blocking, or at least current-restricting, structures. The choking technique proposed here is believed to force the currents excited by a probe to take a larger path than would normally occur, because the "short circuit" current path would be choked off, or at least greatly restricted, by the choke structure. In addition, a portion of the body of the vehicle could be isolated to serve as the antenna, minimizing changes in antenna performance due to changes in the grounding of the vehicle and radiation hazards to personnel. One of the key features of the antenna systems which could result from the proposed concept is that they are expected to be readily applicable or retrofittable to existing vehicles with little or no modification. That is, in the proposed configurations (described further in the following section), the choke structure can either be directly attached to the skin of the vehicle or first be attached to a conductive metal sheet which is in turn attached to the vehicle. The thickness of the metal sheet is governed more by mechanical characteristics than electrical requirements; the sheet is only required to be about 10 skin depths thick. For aluminum at 10 MHz the required thickness is less than 1 millimeter. The antenna could then be covered with a plastic or fiber material such as Kevlar for robustness. "Vehicle" as used herein refers to a "conveyance", and as such may include, for example, aircraft and ships in addition to land vehicles.

Suitable choke structure materials for the antenna designs described herein include high permeability ferrite materials, and high permeability powders suspended in an insulating medium. "Soft" ferrite materials, which generally do not retain permanent magnetization after exposure to an electromagnetic field, are believed to be particularly suitable. Materials which retain some residual magnetization may also be suitable, however. Suitable soft ferrite materials may include, for example, nickel-zinc ferrite. Choke structures made from such ferrite materials are believed to function by locally increasing the surface reactance of the adjacent conducting surface. Because currents on (or in) a conductor are restricted to a region very near the surface by the skin effect, increasing the surface reactance effectively increases the impedance seen by currents in the conductor so that the currents are prevented from crossing the path of the choke structure. Ferrite materials having high relative permeability function most effectively as choke structures. The relative permeabilities of soft ferrite materials are frequency dependent. However, for many materials, the permeability is fairly constant over a very broad frequency range. In general, the choking structures can be thought of as having an inductance per unit length that is proportional to the permeability of the magnetic material. Therefore, the reactance per unit length and hence the choking effectiveness is proportional to both the permeability of the material and the frequency. Relative permeabilities of approximately 100 or greater are believed to be sufficient to form usable choke structures at HF frequencies while relative permeabilities of 10–20 are thought to be needed in the VHF range. Although higher-frequency characteristics of commercially available soft ferrite materials are not always provided by the manufacturers, experimentation suggests that nickel-zinc ferrites such as Fair-Rite 61, 67, and 68 materials exhibit effective choking behavior up to frequencies of at least about 200 MHz. A suitable suspended powder material may be the powdered iron material often used in low-loss VHF transformers. This material provides better high frequency performance but exhibits lower permeability than soft ferrite and hence appears to be useful for implementing choke-defined antennas at higher VHF frequencies.

Suitable conductive structures for the antennas described herein include land vehicles (e.g., automobiles, trains, military vehicles), aircraft, ships, and stationary structures such as buildings and water towers. Such low profile antennas are useful in military applications because they provide low observability and extreme mechanical robustness. In civilian law enforcement, they can provide for clandestine communications. In commercial applications they allow implementation of antenna systems for which aesthetic considerations preclude the presence of any visible antenna structures; for example, pager antennas in urban/suburban areas. Finally, because the nature of the antenna system operation involves the confinement of current flow to specific portions of a structure surface, the technique naturally enhances safety in that the RF current is prevented from flowing on portions of the surface that might incidentally come into contact with personnel or other equipment. The method and antenna structure described herein may be particularly useful for MF, HF, and VHF systems in which long wavelengths require physically large radiating elements in order to provide acceptable bandwidth and efficiency.

It is noted that, in embodiments of the antennas recited herein which use ferrite in the choke structures, the action of the ferrite is different from that of the ferrite in a ferrite-loaded loop antenna. In a ferrite-loaded loop antenna, ferrite material is used for energy storage and the losses in the ferrite material are of paramount importance. Here, the ferrite material is being used only to choke or block currents and hence the losses are of secondary importance. We note that the application of ferrite material to the conducting body of a vehicle will actually diminish the vehicle's RADAR observability because of the losses of the ferrite material at SHF and EHF frequencies.

It is also noted that the choking concept described herein is different from the concept of implementing artificial "soft" or "hard" surfaces for which magnetic material coatings have been employed. Such surfaces have provided some marginal improvement in the performance of element antennas. However, coating an entire surface uniformly simply amounts to the exchange of one type of ground plane boundary condition for another, rather than actually using the surface itself as an antenna.

Finally, it should also be noted that while some dissipation loss occurs in the ferrite, current broadband electrically-small HF (and VHF) antennas operate at very low efficiencies; between 1 and 50 percent. Because of the much greater area over which currents are distributed in the proposed antennas, much higher efficiencies are expected.

BRIEF DESCRIPTION OF THE DRAWINGS

FIG. 1*a* a shows a top view of the antenna structure; and, FIG. 1*b* shows a cross-sectional view of FIG. 1*a*.

FIG. 8*a* shows a belt formed of flat plates of ferrite or other magnetic material placed on a ground plane or conductor.

DETAILED DESCRIPTION OF THE PREFERRED EMBODIMENTS

Figure 1A:
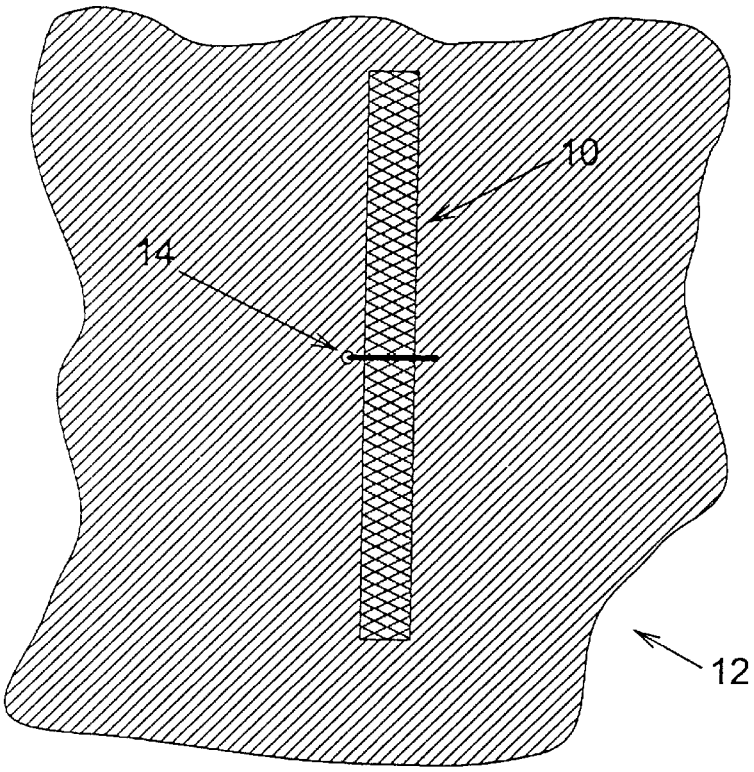
FIGS. 1*a* and 1*b* Simple, choke-defined antenna formed with a single ferrite belt placed on a conducting surface such as the roof or side of the vehicle.
Figure 1B:
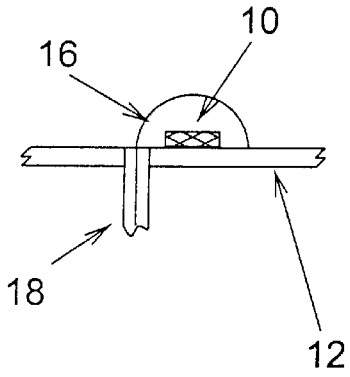

In an embodiment shown in FIG. 1, the choke-defined antenna may include a strip 10 of ferrite or other suitable choke material placed on a conducting ground plane 12 such as the top or side of a vehicle. FIG. 1(*a*) shows a top view of the antenna structure, while FIG. 1(*b*) shows a cross-sectional view along cut A–A' of FIG. 1(*a*). A coaxial feed 14 may be employed whereby the shield of coax line 18 is connected to ground plane 12 on one side of strip 10 and coax center conductor 16 is brought up through ground plane 12, looped over choke strip 10, and connected to the ground plane on the other side of the choke strip. Because current is believed to not flow under or through choke strip 10, it is believed to be forced to go around the strip thus taking a much longer current path 19 than if the strip were not in place. This longer path is believed to effectively represent a larger radiating element, thus greatly enhancing radiation. Without choke strip 10, feed 14 alone may be considered a small half-turn loop antenna having poor radiative properties. Because an electric field exists across choke strip 10 in this configuration, it bears some resemblance to a slot radiator and is resonant when the total length of the choke strip is about one-half of a wavelength.

Figure 2:
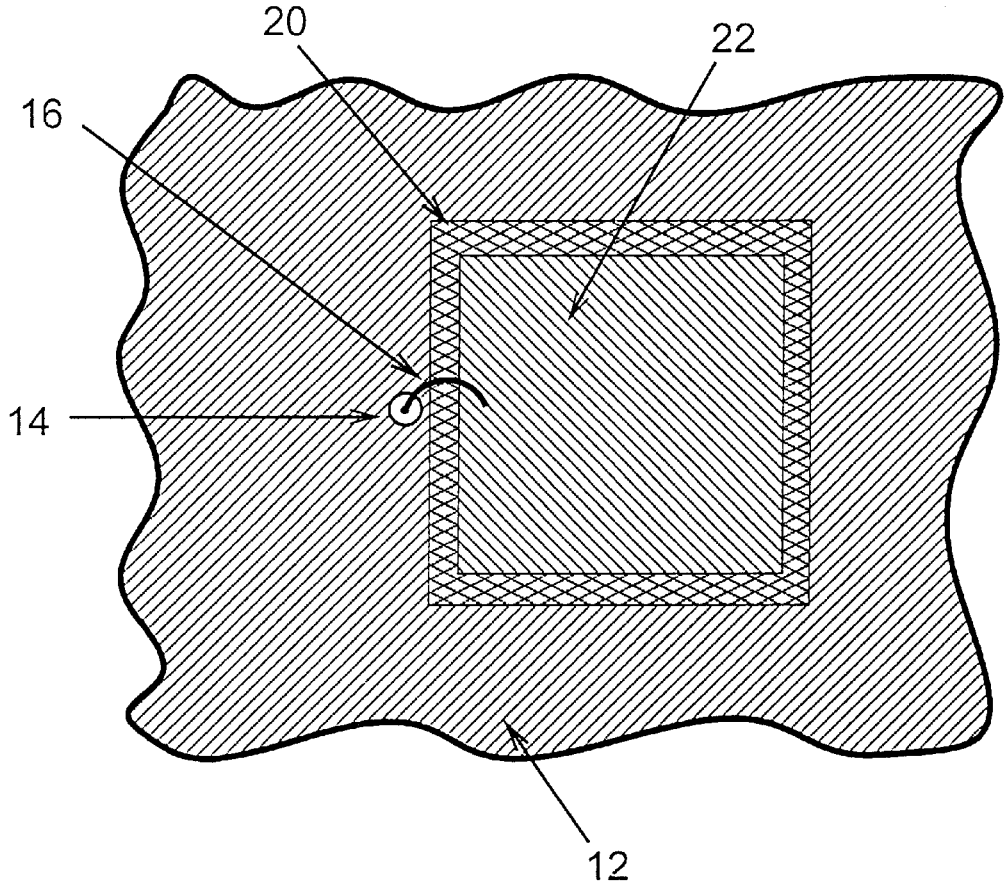
FIG. 2 Simple, choke-defined antenna formed with a single ferrite belt placed on a conducting surface such as the roof or side of a vehicle.

In an alternative embodiment, a ferrite belt 20 may be placed in a loop formation on conducting surface 12 (such as a vehicle body), to form antenna 21 as shown in FIG. 2. The region 22 of conductive surface 12 encircled by loop 20 is effectively isolated from the remainder of the vehicle (or other conductor) over the frequency range for which the ferrite in belt 20 exhibits a large permeability. A possible feed configuration 14 involves bringing coaxial cable out through the surface of the vehicle (outside loop 20) and connecting inner conductor 16 to region 22. Thus, only a high impedance return path is believed to exist for conduction current; most of the input current "returns" as displacement current in the volume around the antenna. Without the choking action of the ferrite, feed arrangement 14 may be viewed as a very small half-turn loop antenna. While such an antenna would excite currents on the conducting surface, the currents would be very localized around the loop. Furthermore, the impedance of the loop would be very small ($<<1\ \Omega$), thus making it difficult to drive with conventional radios. With ferrite belt 20 in place, on the other hand, antenna 21 acts as a large capacitive plate antenna with its attendant bandwidth. (The input impedance to the antenna would, below the first resonance of the antenna, not be capacitive because of the inductive return path under the ferrite. However the radiative mechanism of the antenna would be that of a capacitive antenna.)

Figure 3:
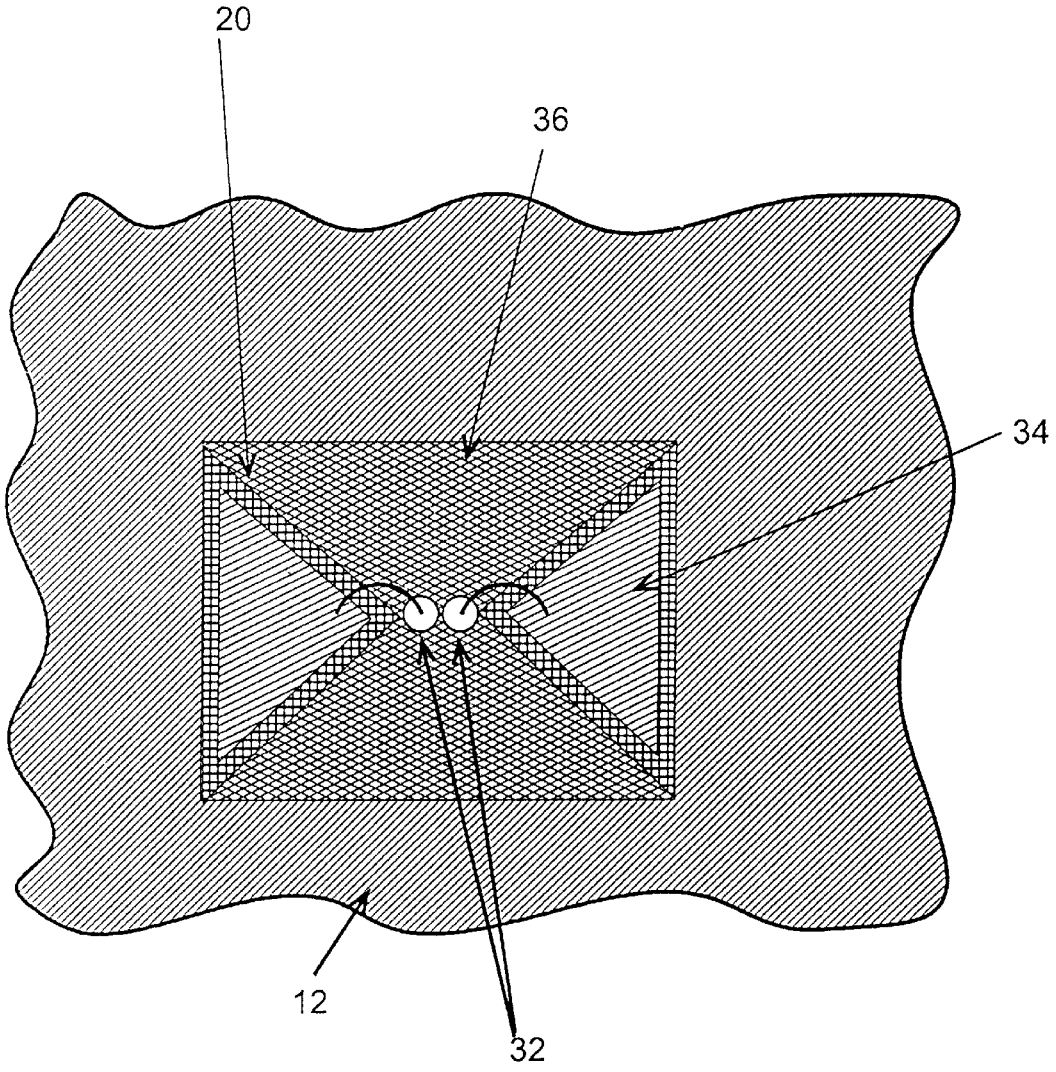
FIG. 3 Broadband, choke-defined bowtie antenna with a balanced feed.

Another possible configuration of the antenna structure includes a broadband geometry such as a bowtie dipole defined using a ferrite belt to choke off the return current as shown in FIG. 3. Here two triangular regions 34 are cordoned off with ferrite belt and are fed with a balancing transformer, or BALUN, through balanced feed 32. One advantage of this balanced system would be a symmetric radiation pattern. Another would be the enhanced bandwidth obtained from the bowtie geometry.

As shown in FIG. 3, it might be useful to simply cover the region between the bowties with ferrite 36 to further impede the shunting current if the choking action of the ferrite belt alone is inadequate. Alternatively, inhomogeneous belt geometries consisting of two or more types of ferrite materials might provide better performance.

Figure 4:
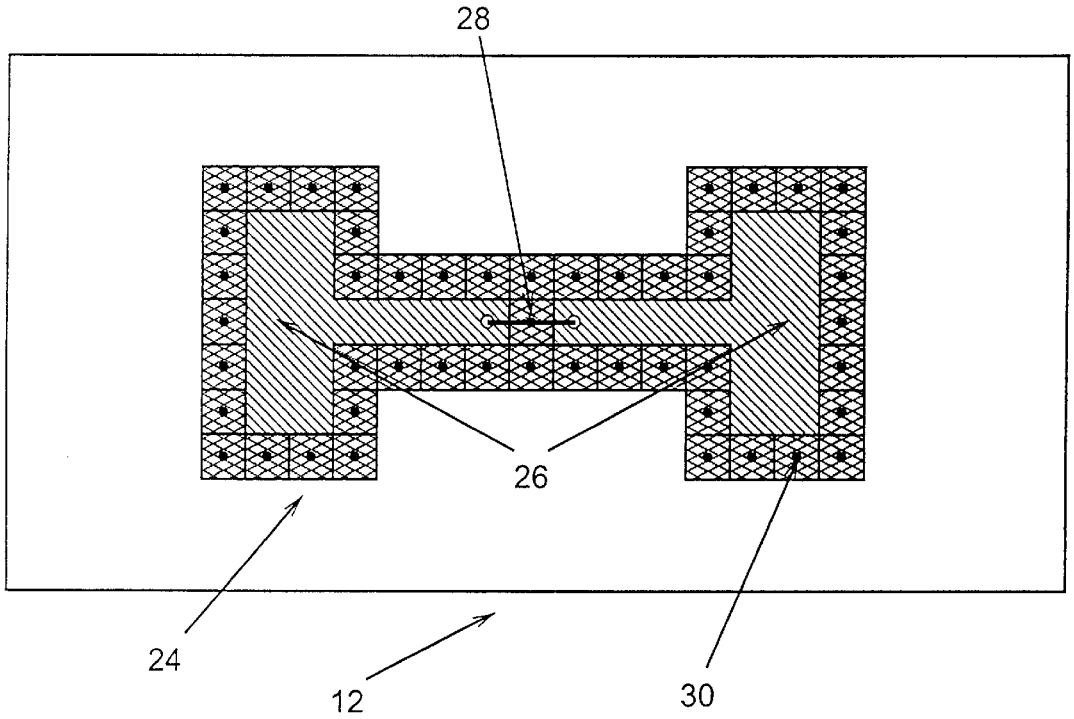
FIG. 4 Broadband, choke-defined antenna composed of commercially-available ferrite tiles with a balanced feed for symmetric pattern.

In another embodiment, a similar configuration to that of FIG. 3 may be obtained using tiles 24 for the choke-restricting structure, as shown in FIG. 4. Various tiles made from, e.g. MnZn or NiZn are commercially available (from, e.g., Fair-Rite Products Corporation or TDK corporation) for radiation absorption applications. Regions 26 of conductive surface 12 are defined using tiles 24, and balanced feed 28 is connected to each of regions 26. Holes 30 are typically provided in tiles 24 to aid in mounting. The tiles may be mounted by other means, however, such as adhesives. In the embodiment of FIG. 4, the conductors of feed 28 are passed through one of holes 30, and the coax shield of feed 28 (not shown) is attached to conductive surface 12 outside of regions 26.

Figure 5:
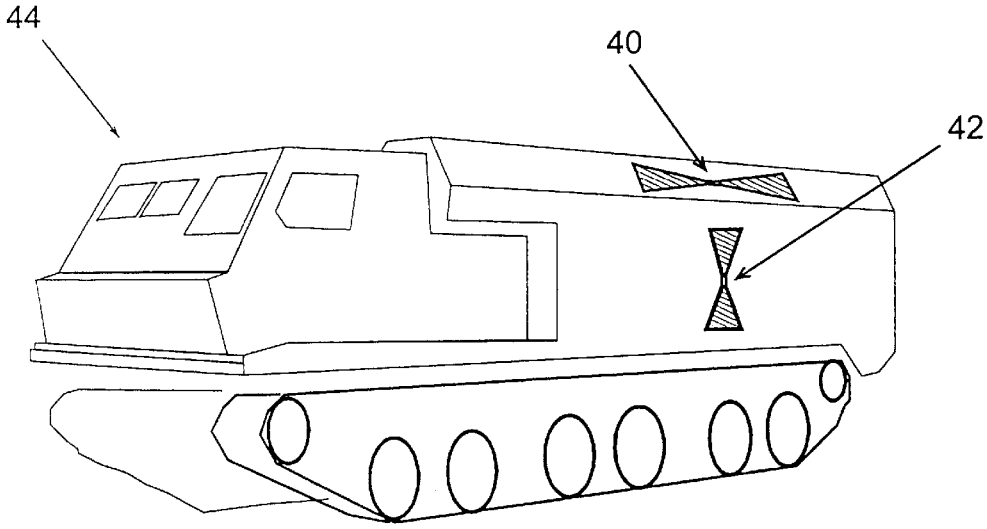
FIG. 5 Dual-polarization, choke-defined antenna for broadband VHF operation on armored vehicle.

A representation of a vehicular antenna using the proposed concept is shown in FIG. 5, in which two bowtie dipoles, one horizontally polarized (dipole 40) and one vertically polarized (dipole 42), are defined with ferrite lines onto the surface of armored personnel carrier 44, e.g. a "command and control vehicle" (C2V).

Figure 6:
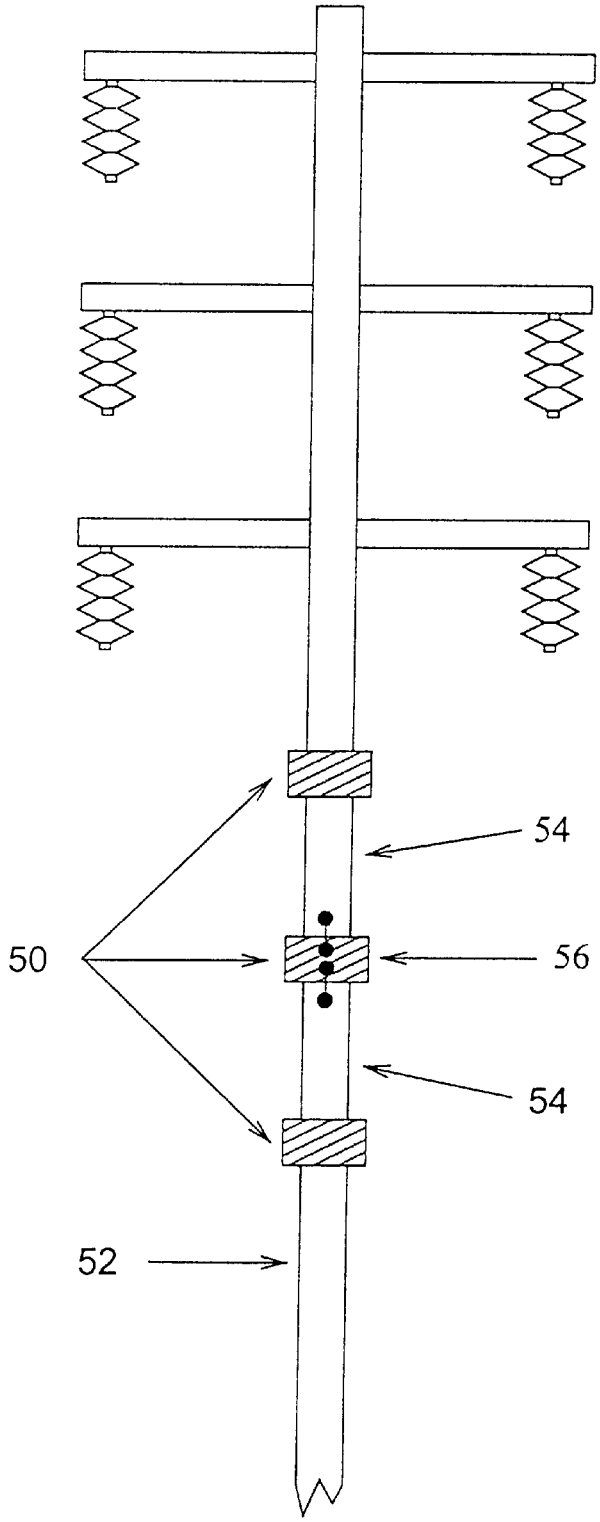
FIG. 6 Choke-defined pager antenna on a steel (or other metal) utility pole.

Turning now to FIG. 6, another embodiment of the choke-defined antenna is shown. This antenna structure is realized using ferrite belts 50 to define two isolated regions 54, which may function as halves of a dipole radiator, on a conducting metal utility pole 52. The dipole is fed using a feed such as feed 56. This antenna should be particularly useful for, e.g., pager applications. Because the utility pole has not been modified other than to have the ferrite belts attached to it, no structural integrity is lost. An additional feature of this antenna is that a direct path to ground exists so that lightning is safely shunted to ground. This direct path exists because most of the energy in a lightning strike is concentrated at frequencies below those where the choking action is effective. In this embodiment, the choke-defined antenna can be placed on structures such as light poles and thus used in areas in which antenna structures would be prohibited by zoning requirements. For example, pager antennas could be provided by utilizing light poles in residential areas.

Figure 7:
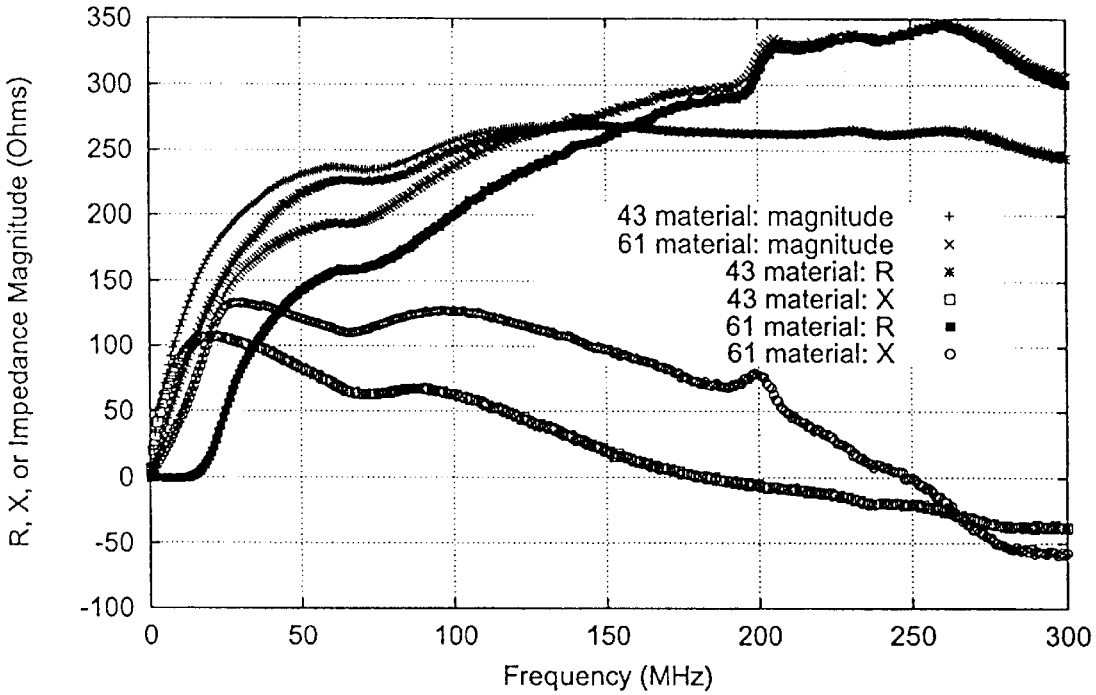
FIG. 7 Impedance across choke beads composed of commercially-available Mn—Zn ferrite materials applied to copper rod.
Figure 8A:
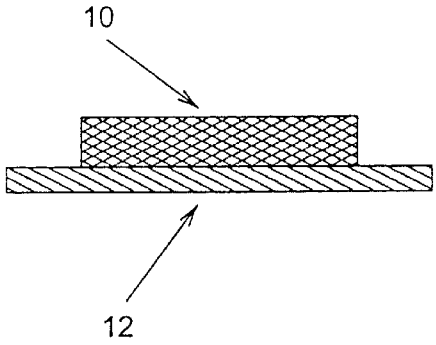
FIGS. 8*a,* 8*b* and 8*c* show cross sectional views of three choke structure geometries as follows.
Figure 8B:
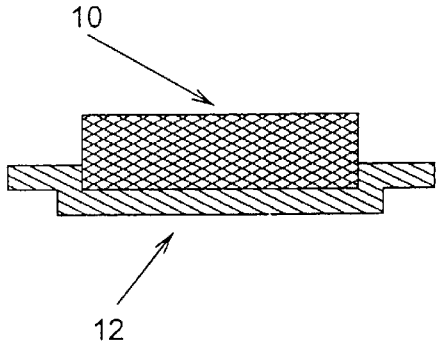
FIG. 8*b* shows that the plates are recessed in the ground plane.
Figure 8C:
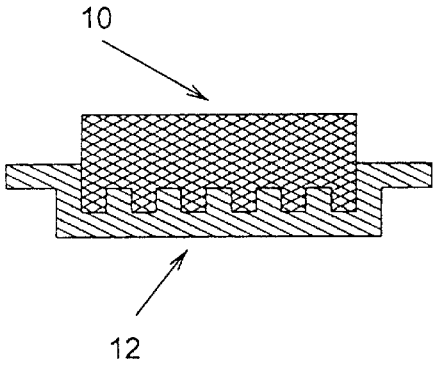
FIG. 8*c* shows a corrugated geometry, including a corrugated portion of a conductor and a matching corrugated portion of a current-restricting structure.

In FIG. 7, the magnitude of the experimentally-determined impedance presented by a choke configuration formed using OFHC copper rod (0.250 inch diameter, 1.125 inches length) surrounded by a ferrite choke "bead" (inside diameter 0.250 inch, outside diameter 0.5 inch, length 1.125 inch) is plotted for two types of Ni—Zn ferrite material: "43 material" (curve 60) and "61 material" (curve 62), both manufactured by Fair-Rite Company. Both "43" and "61" materials are Ni—Zn ferrites and hence both are designed for high frequency operation. The "43" material is designed to have a higher initial permeability but a lower operating frequency range. As can be seen, the bead causes the copper rod to have a very high impedance over a very broad range of frequencies. In FIG. 7, the real and imaginary components of these two impedances are also shown (curves 64 and 66, respectively, for the "43" material, and curves 68 and 70 for the "61" material). Note that the impedance of the "43" material choke actually becomes capacitive above 190 MHz and that of the "61" material becomes capacitive above 250 MHz. Nevertheless, the impedance magnitudes 60 and 62 and hence the choking effectiveness of the materials are still quite large. In FIG. 8, cross-sectional views of three choke structure geometries are shown. The first, in FIG. 8(*a*), represents essentially a belt 10 formed of flat plates of ferrite or other magnetic material placed on a ground plane or conductor 12. In the second geometry of FIG. 8(*b*), the plates are recessed in the ground plane. This provides for a longer path (and hence better choking action) under the belt. Finally, in the third geometry shown in FIG. 8(*c*), a corrugated geoemtry, including corrugated portion 72 of conductor 12 and matching corrugated portion 74 of current-restricting structure 10, provides an even longer path and hence even better choking action.

All of the antenna structures disclosed herein can be made and used without undue experimentation in light of the present disclosure. While the method and antenna structures have been described in terms of preferred embodiments, it will be apparent to those skilled in the relevant art that variations may be applied to the method and structures described herein without departing from the concept, spirit and scope of the invention.

More specifically, it will be apparent that distortions of the shape of the choking structures presented here may be employed while the same or similar results would be achieved. All such similar substitutes and modifications apparent to those skilled in the art are deemed to be within the spirit, scope and concept of the invention.

What is claimed is:

1. An antenna structure, comprising:

a conductor comprising a conductive surface; and a current-restricting structure arranged upon the conductive surface to define current paths in the conductor.

2. The antenna structure as recited in claim 1, wherein an area of the conductive surface is greater than an area of the current-restricting structure.

3. The antenna structure as recited in claim 1, wherein the conductor is within the body of a vehicle.

4. The antenna structure as recited in claim 2, wherein the vehicle comprises an aircraft, a ship or a land vehicle.

5. The antenna structure as recited in claim 1, wherein the conductor forms is within the body of a structure.

6. The antenna structure as recited in claim 5, wherein the structure comprises a building or a container.

7. The antenna structure as recited in claim 1, wherein the current-restricting structure comprises a ferrite material.

8. The antenna structure as recited in claim 7, wherein the ferrite material comprises a soft ferrite material.

9. The antenna structure as recited in claim 7, wherein the ferrite material exhibits a relative permeability greater than or equal to approximately 100 at a frequency less than or equal to approximately 30 MHz.

10. The antenna structure as recited in claim 7, wherein the ferrite material exhibits a relative permeability greater than or equal to approximately 10 at a frequency less than or equal to approximately 300 MHz.

11. The antenna structure as recited in claim 1, wherein the current-restricting structure comprises a cord or belt.

12. The antenna structure as recited in claim 1, wherein the current-restricting structure comprises a plate or tile.

13. The antenna structure as recited in claim 1, wherein the current-restricting structure comprises a patterned layer of a current-restricting material.

14. The antenna structure as recited in claim 1, wherein the conductor comprises a pole, and the current restricting structure encircles the pole.

15. The antenna structure as recited in claim 1, wherein the current-restricting structure is arranged within a recess in the conductive surface.

16. The antenna structure as recited in claim 1, wherein the conductive surface comprises a corrugated portion and the current-restricting surface comprises a matching corrugated portion.

17. The antenna structure as recited in claim 1, further comprising a feed connection configured for application of a voltage between a first portion of the conductive surface and a second portion of the conductive surface, wherein said first and second portions of the conductive surface are separated by at least a portion of the current-restricting structure.

18. A method for forming an antenna structure, comprising arranging a current-restricting structure upon a surface of a conductor to define current paths in the conductor.

19. The method as recited in claim 18, wherein said arranging comprises arranging a current-restricting structure comprising a ferrite material.

20. The method as recited in claim 18, wherein said arranging comprises arranging a loop or belt upon the surface of the conductor.

21. The method as recited in claim 18, wherein said arranging comprises arranging a plate or tile upon the surface of the conductor.

22. The method as recited in claim 18, wherein said arranging comprises depositing a current-restricting material upon the surface of the conductor and patterning the current-restricting material.

23. The method as recited in claim 18, wherein said arranging comprises arranging the current-restricting structure on the conductive surface of a vehicle.

24. The method as recited in claim 18, wherein said arranging comprises arranging the current-restricting structure on the conductive surface of a structure.

25. The method as recited in claim 18, wherein said arranging comprises arranging the current-restricting structure to encircle a conductive pole.

26. The method as recited in claim 18, further comprising forming a feed connection configured for application of a voltage between a first portion of the surface of the conductor and a second portion of the surface of the conductor, wherein said first and second portions of the surface of the conductor are separated by at least a portion of the current-restricting structure.

27. An antenna structure, comprising:

a conductor comprising a conductive surface; and a current-restricting structure arranged upon the conductive surface to define current paths in the conductor and to form a radiating element in the conductor.

28. A method for forming an antenna structure, comprising arranging a current-restricting structure upon a surface of a conductor to define current paths in the conductor and to form a radiating element in the conductor.

* * * * *